US008784050B2

(12) United States Patent
Rivers et al.

(10) Patent No.: US 8,784,050 B2
(45) Date of Patent: Jul. 22, 2014

(54) AGGREGATE VANE ASSEMBLY

(75) Inventors: Jonathan M. Rivers, Danville, IN (US); Matthew A. Scott, Melbourne (GB)

(73) Assignee: Rolls-Royce Corporation, Indianapolis, IN (US)

( * ) Notice: Subject to any disclaimer, the term of this patent is extended or adjusted under 35 U.S.C. 154(b) by 1072 days.

(21) Appl. No.: 12/815,571

(22) Filed: Jun. 15, 2010

(65) Prior Publication Data

US 2011/0305577 A1 Dec. 15, 2011

(51) Int. Cl.
*F01D 9/04* (2006.01)

(52) U.S. Cl.
USPC ..... 415/186; 415/190; 415/209.4; 416/244 A

(58) Field of Classification Search
USPC ..... 415/186, 189, 190, 208.1, 209.2, 209.3, 415/209.4, 210.1, 144, 182.1, 183, 213.1, 415/214.1; 416/244 R, 244 A, 193 R
See application file for complete search history.

(56) References Cited

U.S. PATENT DOCUMENTS

| | | | | |
|---|---|---|---|---|
| 3,351,319 | A | 11/1967 | Frost | |
| 3,375,971 | A | 4/1968 | Fitton | |
| 3,398,535 | A | 8/1968 | Campbell et al. | |
| 3,472,321 | A | 10/1969 | Ellinger | |
| 3,768,933 | A | 10/1973 | Bouiller et al. | |
| 4,722,184 | A * | 2/1988 | Chaplin et al. | 60/226.1 |
| 4,867,635 | A | 9/1989 | Tubbs | |
| 5,184,459 | A | 2/1993 | McAndrews | |
| 5,201,801 | A | 4/1993 | Smith, Jr. | |
| 6,195,983 | B1 | 3/2001 | Wadia et al. | |
| 6,438,941 | B1 | 8/2002 | Elliott et al. | |

FOREIGN PATENT DOCUMENTS

| | | |
|---|---|---|
| DE | 2 055 365 | 5/1972 |
| EP | 1 403 500 B1 | 1/2006 |

OTHER PUBLICATIONS

Euorpean Search Report, EP 11 25 0589, Rolls-Royce Corporation, May 28, 2013.
Machine Translation, DE 2055365, May 18, 1972.

* cited by examiner

*Primary Examiner* — Edward Look
*Assistant Examiner* — Maxime Adjagbe
(74) *Attorney, Agent, or Firm* — Krieg DeVault LLP

(57) ABSTRACT

An aggregate vane assembly is disclosed herein. The aggregate vane assembly includes a core vane assembly encircling a central longitudinal axis. The core vane assembly has a plurality of core vanes each extending radially between an inner hub and an outer band. The core vane assembly extends along the central longitudinal axis between a first forward end and a first aft end. The aggregate vane assembly also includes a bypass vane assembly disposed on a radially opposite side of the outer band relative to the plurality of core vanes. The bypass vane assembly includes at least one bypass vane extending radially outward from a platform. The bypass vane assembly extends along the central longitudinal axis between a second forward end and a second aft end. The aggregate vane assembly also includes at least one boss fixed with the outer band and operable to engage the bypass vane assembly proximate to the second forward end.

18 Claims, 4 Drawing Sheets

AGGREGATE VANE ASSEMBLY

BACKGROUND OF THE INVENTION

1. Field of the Invention

The invention relates to an assembly of vanes for directing a flow of fluid, such as in a turbine engine for example.

2. Description of Related Prior Art

U.S. Pat. No. 4,867,635, assigned to Rolls-Royce plc, discloses a variable guide vane arrangement for a compressor. The variable guide vane arrangement comprises a plurality of stator vanes rotatably mounted in a stator structure of the compressor. A control ring surrounds and is normally coaxially with the compressor axis, and a plurality of operating levers extend from the control ring to their respective stator vane. The control ring is movable laterally with respect to the axis of the compressor so that the stator vanes in a first half of the compressor are rotated in one direction so that the first half of the compressor operates at a higher pressure ratio and the stator vanes in a second half of the compressor are rotated in the opposite direction so that the second half of the compressor operates at a lower pressure ratio. The half of the compressor operating at a higher pressure ratio is arranged to coincide with a zone of the compressor which has a low intake pressure caused by the inlet flow distortions.

SUMMARY OF THE INVENTION

In summary, the invention is an aggregate vane assembly. The aggregate vane assembly includes a core vane assembly encircling a central longitudinal axis. The core vane assembly has a plurality of core vanes each extending radially between an inner hub and an outer band. The core vane assembly extends along the central longitudinal axis between a first forward end and a first aft end. The aggregate vane assembly also includes a bypass vane assembly disposed on a radially opposite side of the outer band relative to the plurality of core vanes. The bypass vane assembly includes at least one bypass vane extending radially outward from a platform. The bypass vane assembly extends along the central longitudinal axis between a second forward end and a second aft end. The aggregate vane assembly also includes at least one boss fixed with the outer band and operable to engage the bypass vane assembly proximate to the second forward end.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF AN EXEMPLARY EMBODIMENT

The invention, as demonstrated by the exemplary embodiment described below, provides an aggregate vane assembly having improved integration of vanes and simplified assembly. Instead of costly custom fasteners to attach a splitter ring between two vane assemblies a more straight forward assembly method is proposed. These custom fasteners are required to be captive. Further, often a blind assembly with in depth measurements is needed to ensure proper engagement. These disadvantages are avoided in the exemplary embodiment. However, it is noted that any benefits articulated herein may not be realized in all operating environments for all embodiments of the invention. Furthermore, it is noted that the benefits articulated herein are not exhaustive, other benefits may be perceived in the practice of the exemplary embodiment or in the practice of alternative embodiments of the invention. The benefits associated with the exemplary embodiment and described herein are not limitations of the broader invention, but rather demonstrate industrial applicability of the invention through the exemplary embodiment.

Figure 1:
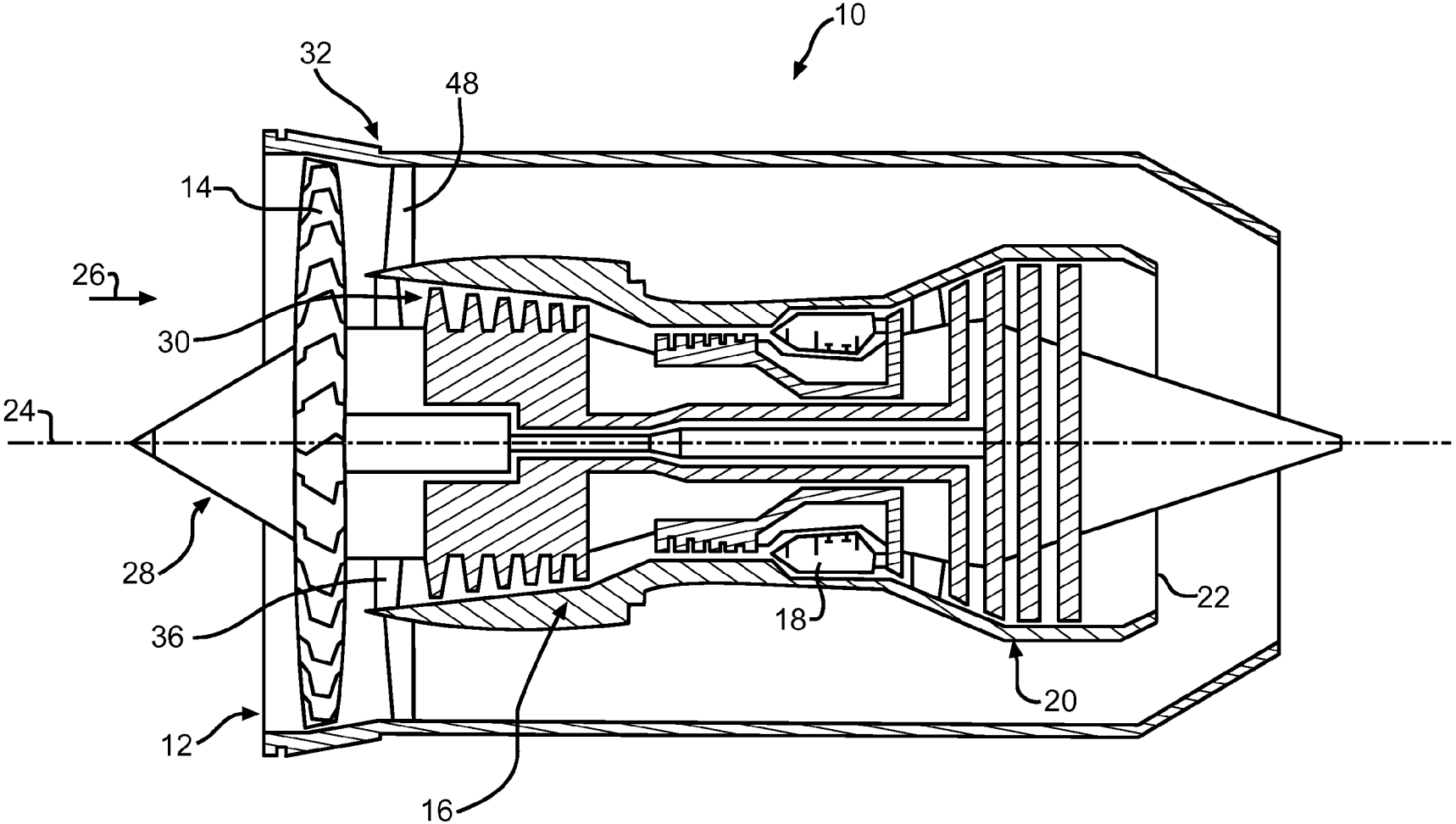
FIG. 1 is a schematic cross-section of a turbine engine incorporating an exemplary embodiment of the invention.

Referring to FIG. 1, a turbine engine 10 can include an inlet 12 and a fan 14. A nose cone assembly 28 can be attached to the fan 14. The exemplary fan 14 can be a bladed disk assembly having a disk or hub defining a plurality of slots and a plurality of fan blades, each fan blade received in one of the slots. The turbine engine can also include a compressor section 16, a combustor section 18, and a turbine section 20. The turbine engine 10 can also include an exhaust section 22. The fan 14, compressor section 16, and turbine section 20 are all arranged to rotate about a centerline axis 24. Fluid such as air can be drawn into the turbine engine 10 as indicated by the arrow referenced at 26. The fan 14 directs fluid to the compressor section 16 where it is compressed. The compressed fluid is mixed with fuel and ignited in the combustor section 18. Combustion gases exit the combustor section 18 and flow through the turbine section 20. Energy is extracted from the combustion gases in the turbine section 20.

Figure 2:
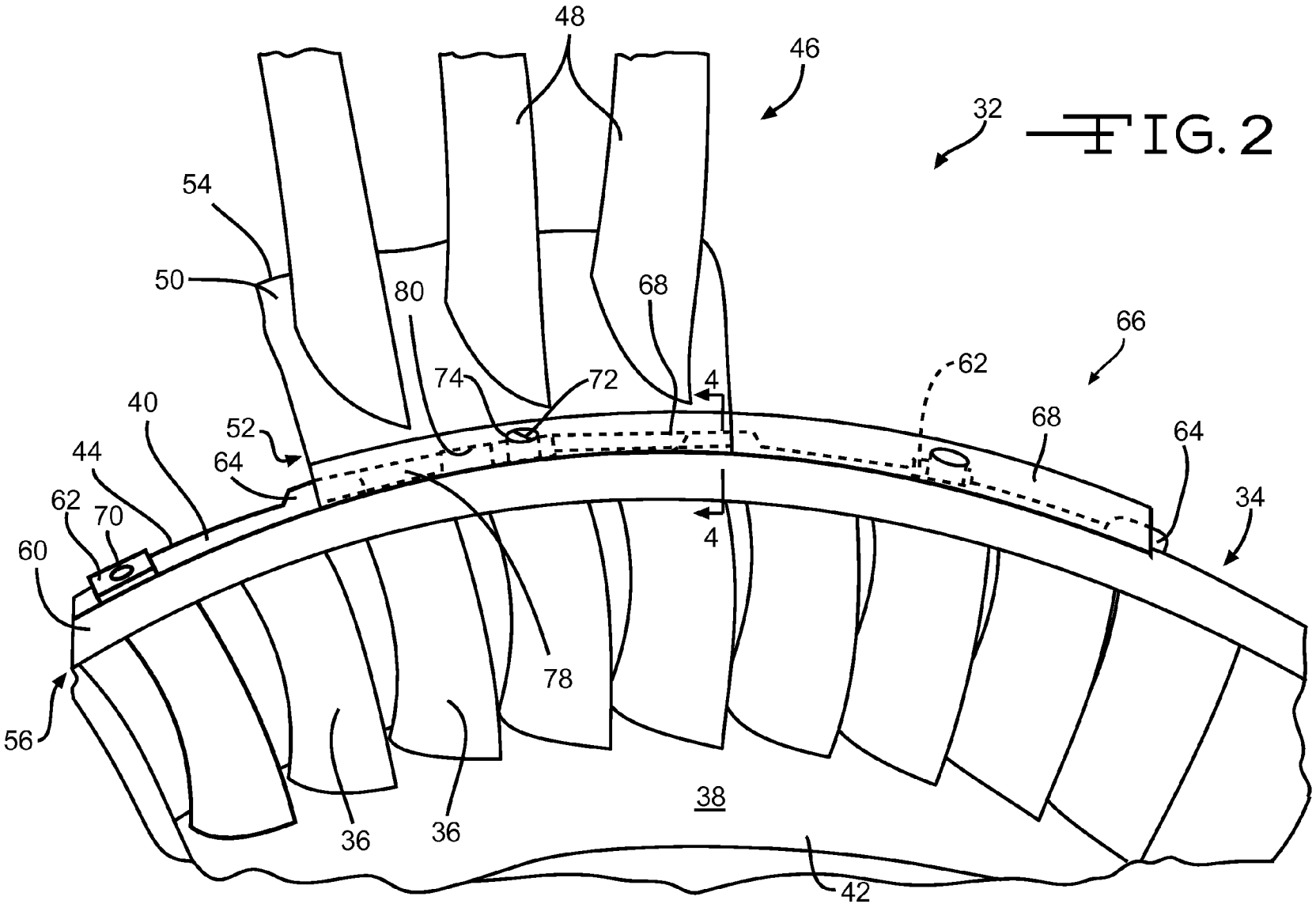
FIG. 2 is a partial perspective view of the exemplary embodiment of the invention looking aft.
Figure 3:
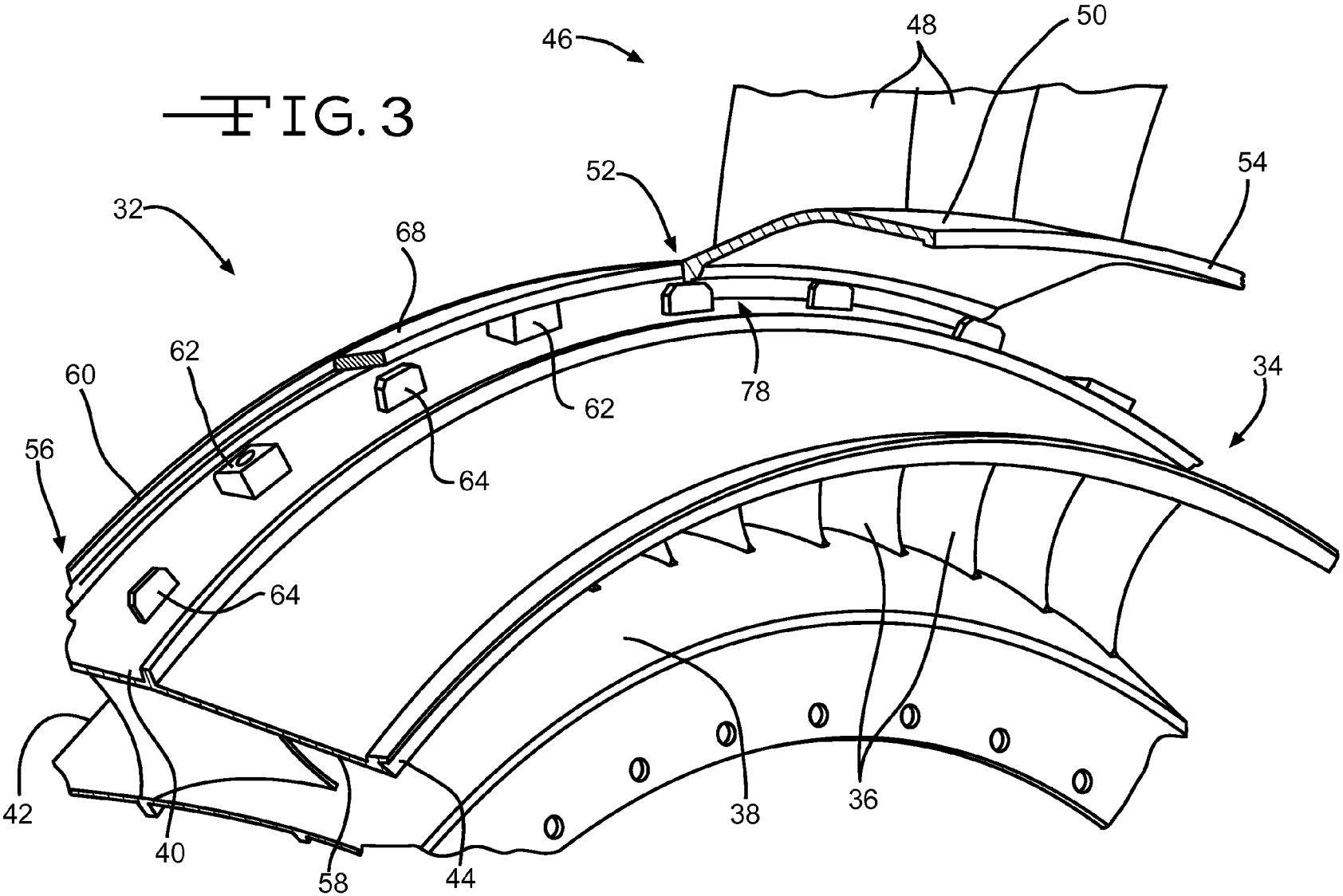
FIG. 3 is a partial perspective view of the exemplary embodiment of the invention looking forward.
Figure 4:
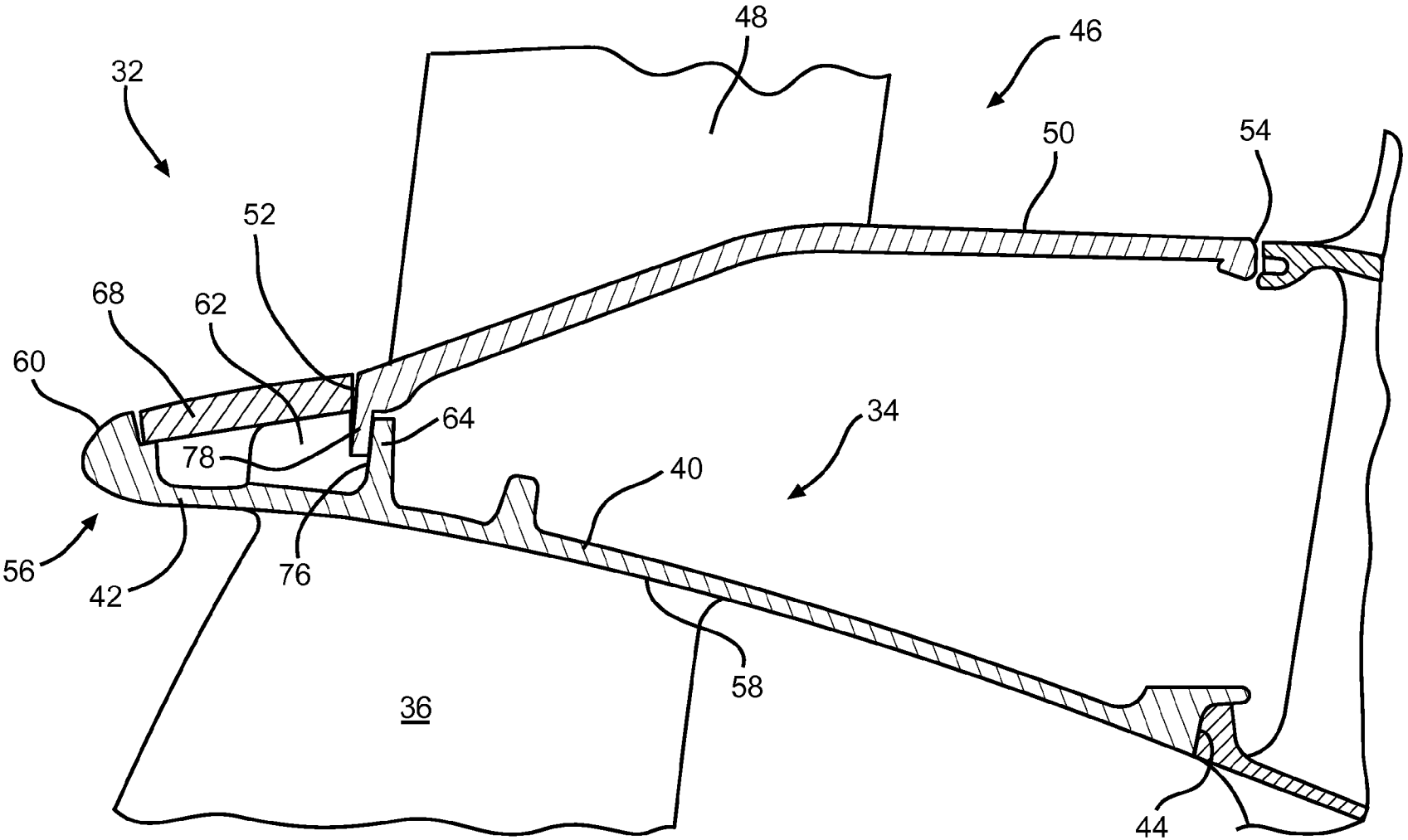
FIG. 4 is a partial cross-section taken through section lines 4-4 in FIG. 2.

The compressor section 16 includes an intake 30. An aggregate vane assembly 32 is positioned upstream and proximate to the intake 30 along the axis 24. As shown in FIGS. 2-4, the aggregate vane assembly 32 includes a core vane assembly 34 encircling a central longitudinal axis. In the exemplary embodiment, the central longitudinal axis 24 is collinear with the centerline axis 24 of the turbine engine 10, shown in FIG. 1. The core vane assembly 34 has a plurality of core vanes 36 each extending radially between an inner hub 38 and an outer band 40. The core vane assembly 34 extends along the central longitudinal axis 24 between a first forward end 42 and a first aft end 44.

The aggregate vane assembly 32 also includes a bypass vane assembly 46 disposed on a radially opposite side of the outer band 40 relative to the plurality of core vanes 36. The bypass vane assembly 46 includes at least one bypass vane 48 extending radially outward from a platform 50. The exemplary bypass vane assembly 46 is a "triplet" with three bypass vanes 48 extending from a common platform 50. A plurality of individual triplets can be positioned fully around the core vane assembly 34. The bypass vane assembly 46 extends along the central longitudinal axis 24 between a second forward end 52 and a second aft end 54. The exemplary platform 50 can be extended along the central longitudinal axis 24 (shown in FIG. 1) such that the first and second aft ends 44, 54 are at substantially the same position along the central longitudinal axis 24. This is shown best in FIG. 4. This eliminates the requirement of a separate piece for guiding the flow of fluid and also for supporting the bypass vanes 48.

A splitter ring 56 can be positioned upstream of the plurality of core vanes 36 and also upstream of the at least one bypass vane 48. The splitter ring 56 can bifurcate the flow of fluid in the turbine engine 10. The core engine flow can pass inside the outer band 40 and the bypass flow can pass outside the outer band 40. The splitter ring 56 can be fixed to the outer band 40 and positioned proximate to the first forward end 42 along the axis 24 (shown in FIG. 1). In the exemplary embodiment, the splitter ring 56 is integral with the outer band 40. As best shown in FIG. 4, a radially inward surface 58 of the outer band 40 can thus be continuous with the outer surface 60 of the splitter ring 56.

The aggregate vane assembly 32 also includes at least one boss fixed with the outer band 40 and operable to engage the bypass vane assembly 46 proximate to the second forward end 52. In the exemplary embodiment, the aggregate vane assembly 32 includes a first set of bosses each referenced at 62 and a second set of bosses each referenced at 64. Also, in the exemplary embodiment, all of the bosses 62, 64 are integral with the outer band 40. It is noted that the invention is not limited to the exemplary embodiment. The at least one boss of an exemplary embodiment can engage the bypass vane assembly 46 to prevent movement of the bypass vane assembly 46.

The bosses 62, 64 of the first set and the second set can be arranged in spaced, alternating relation about the longitudinal axis 24. The sets of first and second bosses 62, 64 can be at least partially spaced from one another along the central longitudinal axis 24. For example, at least part of one of the bosses 62 is spaced from all of the other bosses 64. In the exemplary embodiment, the sets of first and second bosses 62, 64 are adjacent to one another along the axis 24. As best seen in FIG. 4, an aft edge of the boss 62 is substantially aligned with a forward edge 76 of the boss 64.

During assembly of the aggregate vane assembly 32, a lip 78 of the bypass vane assembly 46 extending radially inward from the platform 50 can be positioned to abut the second set of bosses 64 along the central longitudinal axis 24. This is best shown in FIG. 4. The engagement between the lip 78 and the bosses 64 limit movement of the bypass vane assembly 46 along the central longitudinal axis 24.

The lip 78 extends around an arc centered in the axis 24. When the aggregate vane assembly 32 is assembled, the lip 78 partially encircles each of the first bosses 62 about the central longitudinal axis 24. This is best shown FIG. 2. A slot 80 is formed in the lip 78. As a result, the lip 78 abuts the first bosses 62 about the central longitudinal axis 24. The engagement between the lip 78 and the bosses 62 limits movement of the bypass vane assembly 46 about the central longitudinal axis 24. The bosses 62 can provide significant bearing area (often difficult to accommodate) for the bypass vane assembly 46 to be loaded against. The bosses 62, 64 are thus differently shaped from one another to accomplish different purposes.

After the bypass vane assembly 46 has been positioned relative to the core vane assembly 34, a ring 66 formed from a plurality of ring segments 68 can be positioned around the outer band 40 to prevent separation. As best shown in FIG. 2, each ring segment 68 can be mounted on one of the first bosses 62. As best shown in FIG. 4, each ring segment 68 can be positioned between the splitter ring 56 and the bypass vane assembly 46 along the central longitudinal axis 24. Each of the first set of bosses 62 can define a threaded aperture 70. A fastener 72 can be inserted through an aperture 74 formed in the ring segment 68 and the threaded aperture 70 of the boss 62. Assembly is thus simplified in that the ring segments 68 can be lined up clearly with the threaded apertures 70 on the bosses 62 and the fasteners 72 then rotated to a predetermined level of torque. The ring segments 68 do not need to be placed in any particular order to accomplish installation.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. An aggregate vane assembly comprising:

a core vane assembly encircling a central longitudinal axis and having a plurality of core vanes each extending radially between an inner hub and an outer band wherein said core vane assembly extends along said central longitudinal axis between a first forward end and a first aft end;

a bypass vane assembly disposed on a radially opposite side of said outer band relative to said plurality of core vanes, said bypass vane assembly including at least one bypass vane extending radially outward from a platform and said bypass vane assembly extending along said central longitudinal axis between a second forward end and a second aft end, and said bypass vane assembly including a lip extending from the platform;

a ring formed of a plurality of ring segments; and a plurality of bosses fixed with said outer band and operable to engage said bypass vane assembly proximate to said second forward end wherein said plurality of bosses includes a first set of bosses and a second set of bosses;

wherein said ring segments are secured to said first set of bosses;

wherein engagement between said lip and said first set of bosses limits movement of the bypass vane assembly about the central longitudinal axis; and wherein engagement between said lip and said second set of bosses limits movement of the bypass vane assembly along the central longitudinal axis.

2. The aggregate vane assembly of claim 1 wherein said plurality of bosses is integral with said outer band.

3. The aggregate vane assembly of claim 1 wherein said first set of bosses and a second set of bosses are at least partially spaced from one another along said central longitudinal axis.

4. The aggregate vane assembly of claim 1 wherein said first set of bosses and a second set of bosses are spaced from one another about said central longitudinal axis.

5. The aggregate vane assembly of claim 1 wherein said first set of bosses and a second set of bosses are differently shaped from one another.

6. The aggregate vane assembly of claim 1 wherein at least one boss of the first set of bosses has a threaded aperture.

7. The aggregate vane assembly of claim 1 further comprising:

a splitter ring fixed to said outer band and positioned proximate to said first forward end and forward of said plurality of bosses along said central longitudinal axis.

8. The aggregate vane assembly of claim 7 wherein said splitter ring is integral with said outer band.

9. The aggregate vane assembly of claim 7, wherein said ring segments are mountable on said first set of bosses and positioned between said splitter ring and said bypass vane assembly along said central longitudinal axis.

10. The aggregate vane assembly of claim 1 wherein said lip extends radially inward from said platform, said lip engaging at least one boss of said first set of bosses to limit movement of said bypass assembly relative to said core vane assembly.

11. The aggregate vane assembly of claim 10 wherein said lip abuts said at least one boss along said central longitudinal axis.

12. The aggregate vane assembly of claim 10 wherein said lip abuts said at least one boss about said central longitudinal axis.

13. A method comprising the steps of:

encircling a central longitudinal axis with a core vane assembly having a plurality of core vanes each extending radially between an inner hub and an outer band wherein the core vane assembly extends along the central longitudinal axis between a first forward end and a first aft end;

disposing a bypass vane assembly on a radially opposite side of the outer band relative to the plurality of core vanes, the bypass vane assembly including at least one bypass vane extending radially outward from a platform and the bypass vane assembly extending along the central longitudinal axis between a second forward end and a second aft end; and fixing at least one boss with the outer band and operable to engage the bypass vane assembly proximate to the second forward end;

limiting movement of the bypass vane assembly along the central longitudinal axis with a first boss;

limiting movement of the bypass vane assembly about the central longitudinal axis with a second boss different from the first boss.

14. The method of claim 13 further comprising the step of: limiting movement of the bypass vane assembly along the central longitudinal axis with the at least one boss.

15. The method of claim 13 further comprising the step of: limiting movement of the bypass vane assembly about the central longitudinal axis with the at least one boss.

16. The method of claim 13 further comprising the step of: extending the platform along the central longitudinal axis such that the first and second aft ends are at substantially the same position along the central longitudinal axis.

17. The method of claim 13 further comprising the step of: integrally forming the at least one boss and a splitter ring with the outer band.

18. A turbine engine comprising:

a compressor section having an intake;

a core vane assembly positioned upstream of said compressor section and encircling a central longitudinal axis, said core vane assembly having a plurality of core vanes each extending radially between an inner hub and an outer band wherein said core vane assembly extends along said central longitudinal axis between a first forward end and a first aft end, said first aft end proximate to said intake;

a bypass vane assembly disposed on a radially opposite side of said outer band relative to said plurality of core vanes, said bypass vane assembly including at least one bypass vane extending radially outward from a platform and said bypass vane assembly extending along said central longitudinal axis between a second forward end and a second aft end;

a splitter ring positioned upstream of said plurality of core vanes and said at least one bypass vane, said splitter ring bifurcating flow in said turbine engine with core engine flow passing inside said outer band and bypass flow passing outside said outer band;

a plurality of bosses fixed with said outer band and operable to engage said bypass vane assembly proximate to said second forward end, said plurality of bosses including a first set of bosses each defining a threaded aperture and a second set of bosses wherein said bosses of said first set and second set are arranged in alternating relation about said longitudinal axis;

a ring having a plurality of segments, each segment releasably mountable with a fastener on one of said first set of bosses and positioned between said splitter ring and said bypass vane assembly along said central longitudinal axis; and a lip extending radially inward from said platform, said lip abutting said second set of bosses along said central longitudinal axis and partially encircling said first set of bosses about said central longitudinal axis.

* * * * *